US011394134B1

(12) United States Patent
D'Ascanio et al.

(10) Patent No.: US 11,394,134 B1
(45) Date of Patent: Jul. 19, 2022

(54) CAMLOCK ELECTRICAL CONNECTOR

(71) Applicants: Franco L D'Ascanio, Key Colony Beach, FL (US); Sean P Snowden, Marathon, FL (US); Harold M. Zimmermann, Stuart, FL (US)

(72) Inventors: Franco L D'Ascanio, Key Colony Beach, FL (US); Sean P Snowden, Marathon, FL (US); Harold M. Zimmermann, Stuart, FL (US)

(73) Assignee: COASTAL SOURCE, LLC, Marathon, FL (US)

( * ) Notice: Subject to any disclaimer, the term of this patent is extended or adjusted under 35 U.S.C. 154(b) by 0 days.

(21) Appl. No.: 17/651,465

(22) Filed: Feb. 17, 2022

(51) Int. Cl.
*H01R 4/2412* (2018.01)
*H01R 13/52* (2006.01)
*H01R 13/506* (2006.01)

(52) U.S. Cl.
CPC ..... *H01R 4/2412* (2013.01); *H01R 13/506* (2013.01); *H01R 13/5221* (2013.01)

(58) Field of Classification Search
CPC . H01R 4/2412; H01R 13/506; H01R 13/5221
See application file for complete search history.

(56) References Cited

U.S. PATENT DOCUMENTS 4,029,383 A * 6/1977 Harding ..... H01R 4/5008 439/864
5,190,469 A * 3/1993 Mui ..... H01R 4/24 439/425

FOREIGN PATENT DOCUMENTS

DE 9311308 U1 * 11/1993

* cited by examiner

*Primary Examiner* — Tho D Ta
(74) *Attorney, Agent, or Firm* — Stuart M. Goldstein

(57) ABSTRACT

A camlock electrical connector has a first connector member with a bottom platform having an opening and an upstanding wall. Pin elements extend outwardly from the wall and a cable connector extends outwardly from and externally of the wall. A second connector member has a connector body with a fulcrum peg extending downwardly from the body. The peg is inserted into the opening in the platform, such that the second connector member is rotatable in relation to the first connector member. When electrical wiring is positioned between the wall of the first connector and the body of the second connector member, rotation of the second connection member and its peg in relation to the first connection member causes the pin elements to pierce the electrical wiring, thereby securing the wiring to the electrical connector.

8 Claims, 3 Drawing Sheets

CAMLOCK ELECTRICAL CONNECTOR

FIELD OF THE INVENTION

The present invention relates generally to electrical connectors, and more particularly to insulation displacement connectors used to connect conventional zipcord-type electrical wire to plug and play cabling.

BACKGROUND OF THE INVENTION

Insulation displacement connectors (IDC) are commonly utilized for creating connections between insulated electrical wiring and various electrical components. While there are many varieties of IDCs, there are few which are specifically designed for plug and play connections and none which provide a compact, simple, repeatable and reliable IDC which allows trunk and branch wiring with varying connector intervals.

SUMMARY OF THE INVENTION

It is thus the object of the present invention to overcome the limitations and deficiencies of existing IDCs utilized for plug and play cabling and like applications, by providing a unique IDC in the form of a camlock electrical connector.

This and other objects are accomplished by the present invention, a camlock electrical connector for providing a secure watertight connection between electrical wiring and plug and play cabling. The electrical connector has a first connector member with a bottom platform having an opening and a wall upstanding from the platform. Pointed pin elements extend outwardly from the wall and a cable connector extends outwardly from and externally of the wall. A second connector member has a connector body with a fulcrum peg extending downwardly from the body. The peg is configured to be inserted into the opening in the platform, the second connector member with its peg being rotatable in relation to the first connector member. When the peg is inserted into the opening and electrical wiring is positioned between the wall of the first connector and the body of the second connector member, rotation of the second connection member and its peg in relation to the first connection member causes the pin elements to pierce the electrical wiring, thereby securing the wiring to the electrical connector.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 2:
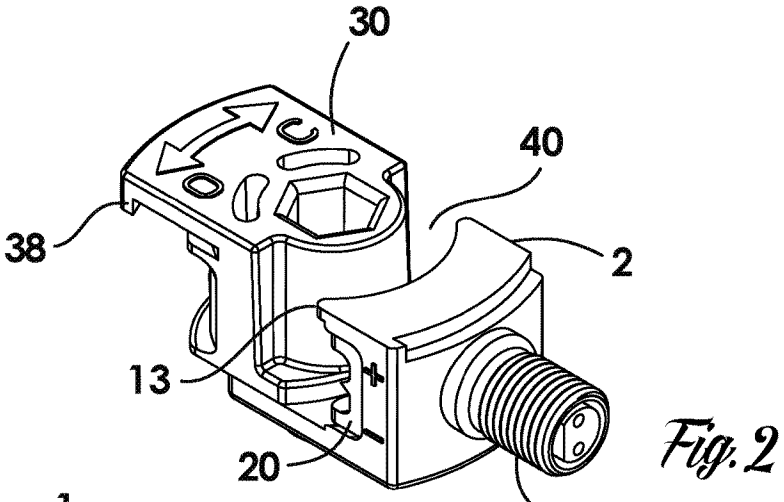
FIG. 2 shows the open position of the connector members of the electrical connector of the present invention with its connector members in the open position.
Figure 3:
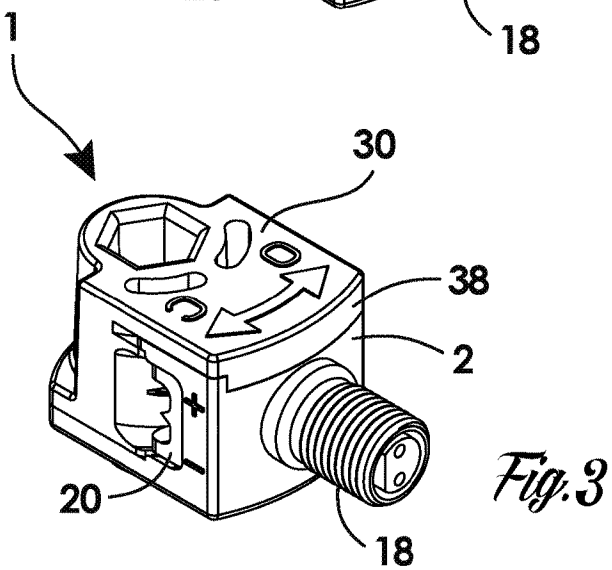
FIG. 3 shows the electrical connector of the present invention with its connector member in the closed position.
Figure 1:
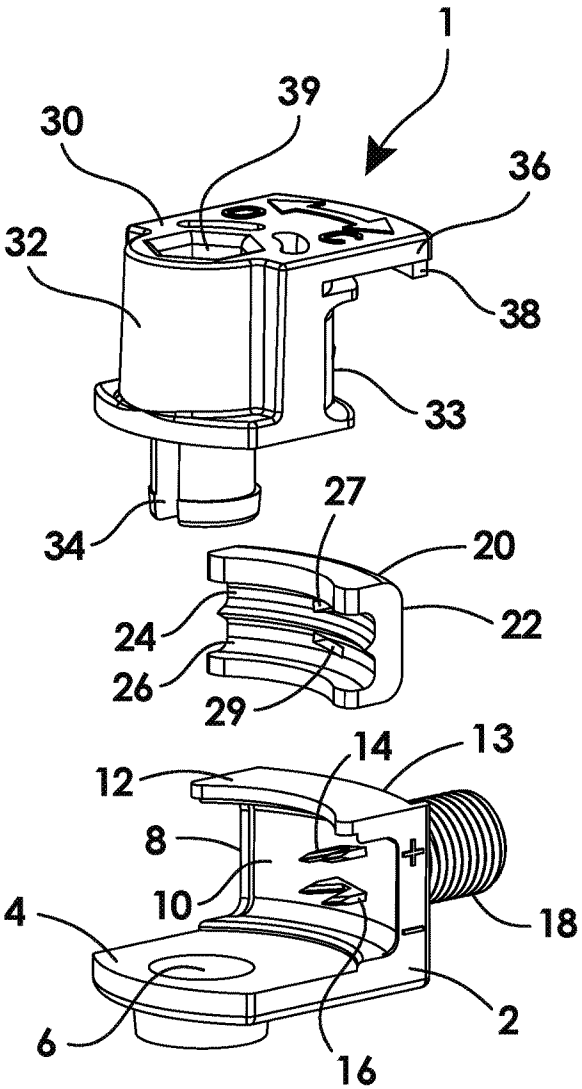
FIG. 1 is an exploded view of the components of the electrical connector of the present invention.

Electrical connector 1 of the present invention comprises first connector member 2 and second connector member 30. Connector members 2 and 30 are configured to be joined in order to provide a secure watertight connection between zipcord electrical wiring and plug and play cabling.

First connector member 2 comprises platform 4 having opening 6 extending through the platform. Wall 8 is upstanding from platform 4 and has modified internal concave surface 10. Cantilevered wall 12 with inset notch 13 overhangs wall 8 and serves to lock connector member 2 with second connector 30, as is further described below. Sharply pointed gold-plated pin elements 14 and 16 extend outwardly from wall 8, in the direction of platform 4. Pin elements 14 and 16 are multi-pronged and angled to allow for increased surface area of the elements' conductors, allowing for a greater margin of error during the installation process. That is, if the installer fails to properly position the electrical wiring between first connector member 2 and second connector member 30, as described in further detail below, the unique orientation of pin elements 14 and 16 assists in assuring that an electrical connection will be made. Threaded cable connector 18 extends outwardly from and externally of wall 8. Through hole 39 with an Allen-key socket is provided for a mounting screw to affix electrical connector 1 to a desired surface. Hole 39 also allows for a means of stacking connectors 1*a*, via peg 34*a*, as illustrated in FIGS. 7-10; thus establishing increased versatility by providing additional plug and play options.

Guide member 20 is located adjacent to wall 8. It has modified convex outer surface 22 which corresponds with concave surface 10 of wall 8. Channels 24 and 26 within guide member 20 have modified concave surfaces, configured to except electrical wiring within the guide member and, hence within first connector member 2. Slits 27 and 29 extending through channels 24 and 26 are provided for the placement of pin elements 14 and 16 through guide member 20. Guide member 20 acts as a grommet seal which enables electrical connector 1 to achieve an IP68 rating (submersible beyond one meter for thirty minutes).

Second connector member 30 comprises connector body 32, body interior surface 33, and fulcrum peg 34 which extends downwardly from the body. Cantilevered wall 36 with locking tab 38 overhangs connector body 32. Peg 34 of connector member 30 is configured to be inserted into opening 6 of connector member 2, which allows connector member 30 to be rotatable about connector member 2.

Figure 5:
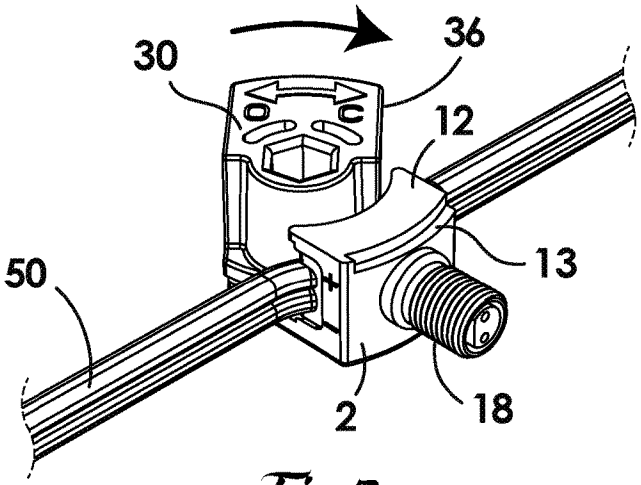
FIGS. 4-6 show the process in which electrical wiring and cabling are secured to the electrical connector of the present invention.
Figure 6:
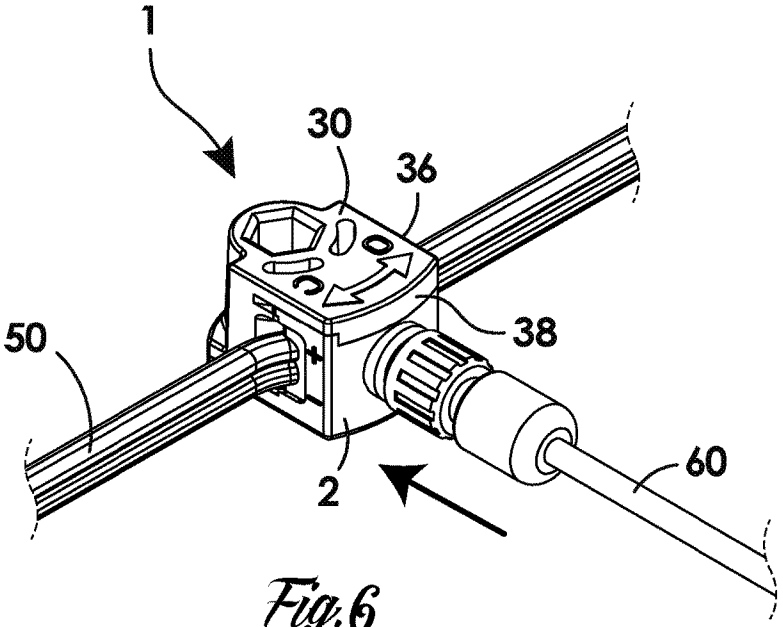
Figure 4:
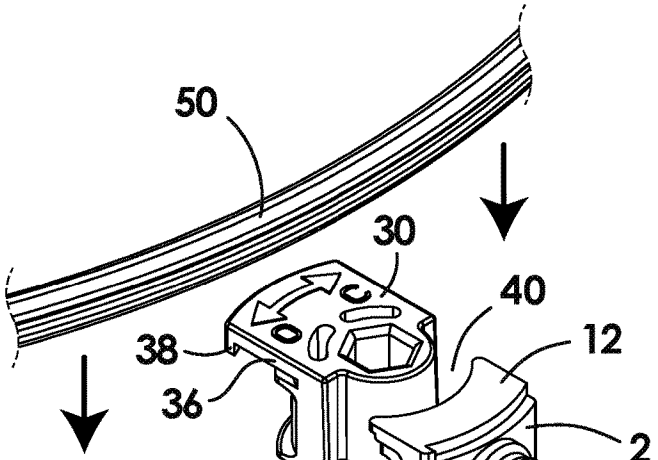
Figure 10:
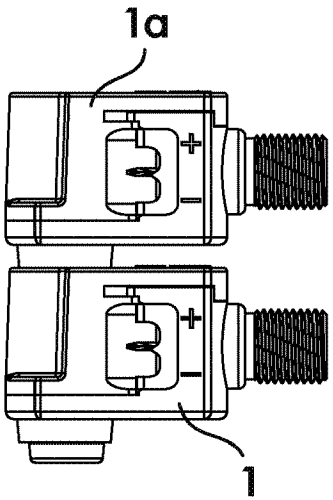
FIGS. 7-10 illustrates the stackable nature of the electrical connector of the present invention.
Figure 9:
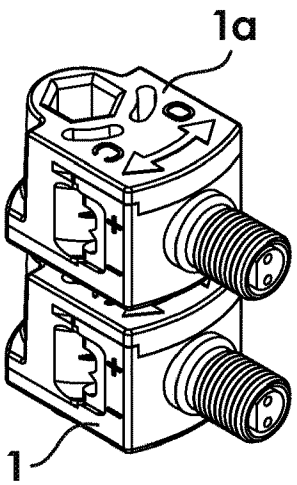
Figure 8:
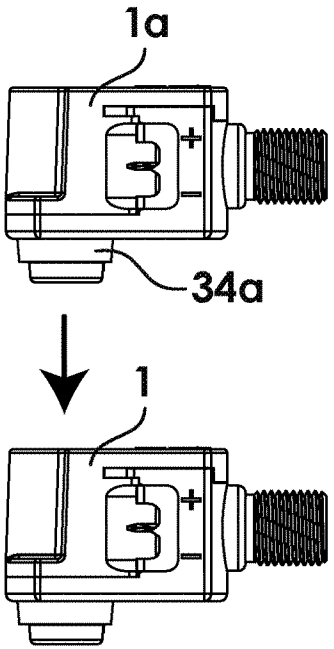
Figure 7:
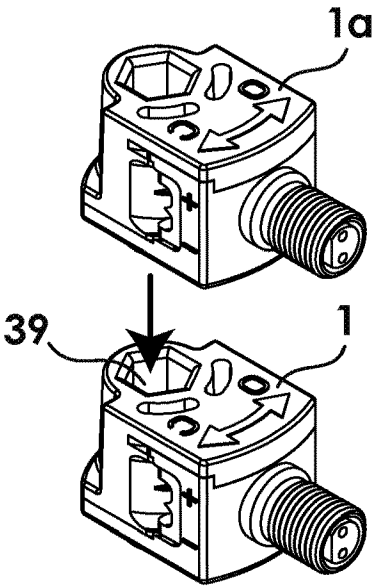

In use, connector member 30 is rotated about connector member 2 to a first, open position, creating open space 40 between the connector members, as seen best in FIGS. 2 and 4. Electrical wiring 50 is then positioned in open space 40, within channels 24 and 26 of guide member 20. See FIG. 5. Connector member 30 is then rotated about its peg 34, within opening 6 of connector member 2, to a second, closed position in which the connector members are locked together, as seen in FIG. 6. In this position, interior surface 33 of connector body 32 is substantially flush against guide member surface 22 and locking tab 38 is inserted into inset notch 13. This establishes a lock between connector members 2 and 30, compressing electrical wiring 50 between these connector members. This results in pointed pin elements 14 and 16 piercing electrical wiring 50, creating an electrical connection between the wiring and cable 60, which is attached to cable connector 18. The plug and play cabling connection has been established.

The present invention, as disclosed, is shown for plug and play output. However, it could also be designed to utilize a conventional zipcord input/output, or integrated into an electrical device, e.g. a light fixture; speaker, etc.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. An electrical connector for providing a secure water-tight connection between electrical wiring and plug and play cabling, said connector comprising:

a first connector member comprising a bottom platform having an opening, a wall upstanding from the platform having pointed pin elements extending outwardly from the wall, and a cable connector; and a second connector member comprising a connector body and a fulcrum peg extending downwardly from the body, the peg being configured to be inserted into the opening in the platform, the second connector member and the peg being rotatable in relation to the first connector member;

wherein when the fulcrum peg is inserted into the opening and electrical wiring is positioned between the wall of the first connector member and the body of the second connector member, rotation of the second connection member and its fulcrum peg in relation to the first connection member, causes the pin elements to pierce the electrical wiring, thereby securing the wiring to the electrical connector.

2. The electrical connector as in claim 1 further comprising a guide member adjacent to the wall of the first connector member, said guide member having channels for positioning the electrical wiring within the electrical connector.

3. The electrical connector as in claim 1 wherein the cable connector extends out from and externally of the wall of the first connector member.

4. The electrical connector as in claim 1 wherein the wall of the first connector member is concave in configuration.

5. An electrical connector for providing a secure water-tight connection between electrical wiring and plug and play cabling, said connector comprising:

a first connector member comprising a bottom platform having an opening, a wall upstanding from the platform having pointed pin elements extending outwardly from the wall, and a cable connector; and a second connector member comprising a connector body and a fulcrum peg extending downwardly from the body, the peg being configured to be inserted into the opening in the platform, the second connector member and the peg being rotatable in relation to the first connector member;

wherein in a first position the fulcrum peg is inserted into the opening creating an open space between the first and second connector members, and in a second position, the second connector member and its fulcrum peg are rotated in relation to the first connector member to lock the connector members together.

6. The electrical connector as in claim 5 further comprising a guide member adjacent to the wall of the first connector member, said guide member having channels for positioning of electrical wiring within the electrical connector.

7. The electrical connector as in claim 5 wherein the cable connector extends out from and externally of the wall of the first connector member.

8. The electrical connector as in claim 5 wherein the wall of the first connector member is concave in configuration.

* * * * *